US007058982B2

(12) United States Patent
Atallah et al.

(10) Patent No.: US 7,058,982 B2
(45) **Date of Patent: *Jun. 13, 2006**

(54) HIGH VISIBILITY CLOTHING CONSTRUCTION

(75) Inventors: Toufic G. Atallah, Reading, MA (US); Stephen J Blauer, Lexington, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/993,314

(22) Filed: Nov. 19, 2004

(65) Prior Publication Data

US 2005/0071907 A1 Apr. 7, 2005

Related U.S. Application Data

(63) Continuation-in-part of application No. 10/174,156, filed on Jun. 18, 2002, now Pat. No. 6,820,280.

(51) Int. Cl.
*A41D 1/04* (2006.01)

(52) U.S. Cl. ..... 2/102

(58) Field of Classification Search ..... 2/102, 2/2.5, 462, 456, 108, 904, 92, 912, 913
See application file for complete search history.

(56) References Cited

U.S. PATENT DOCUMENTS

| | | | | |
|---|---|---|---|---|
| 3,848,267 | A * | 11/1974 | DeSpain | 2/94 |
| 5,495,621 | A * | 3/1996 | Kibbee | 2/2.5 |
| 5,890,227 | A * | 4/1999 | Brown | 2/102 |
| 5,976,669 | A * | 11/1999 | Fleming | 428/143 |
| 6,820,280 | B1 * | 11/2004 | Atallah et al. | 2/102 |

OTHER PUBLICATIONS

Sandra Betzina, Debbie Valentine, Sews for your Home The Taunton Press, 2002, USA.
Singer, Sewing Reference Library, Sewing for the Home, Cy DeCosse Incorporated, 1984, USA.
The Penalty Box, Neu Visions Sports, Ice Hockey Gear, 1993, USA.

* cited by examiner

*Primary Examiner*—Tejash Patel
(74) *Attorney, Agent, or Firm*—Altman & Martin

(57) ABSTRACT

A light weight, high visibility garment is intended to be worn over regular or service clothing. This garment comprises: a front panel and a back panel that extend from the neck to the hips or waist; mating fastener arrangements at the shoulders and hips detachably connecting the front and back panels; and front and rear retro-reflective bands spanning the front and the back panels. Preferably, the mating fastener arrangements at each of the shoulders include a front arrangement that is affixed to the upper edge of the front panel and a rear arrangement that is affixed to an upper edge of the back panel. When one or both of the panels are grasped and pulled, the mating fastener arrangements separate, thereby freeing the front and back panels from each other and from the wearers body.

25 Claims, 7 Drawing Sheets

HIGH VISIBILITY CLOTHING CONSTRUCTION

RELATED APPLICATIONS

The present application is a continuation-in-part of application Ser. No. 10/174,156, filed Jun. 18, 2002, U.S. Pat. No. 6,820,280, dated Nov. 23, 2004.

GOVERNMENT CONTRACTS

Not Applicable

BACKGROUND OF THE INVENTION

1. Field of the Invention

The present invention relates to clothing, particularly, protective clothing, and, more particularly, to high visibility vests, which are worn for safety, daytime or nighttime, over uniforms or other outer clothing, typically by personnel involved in police, fire, safety, hospital, and other public services.

2. The Prior Art

High visibility articles of clothing typically incorporate combinations of luminescent and retro-reflective surfaces, which combine to provide brilliant contrast against relatively obscure daytime and nighttime backgrounds. As is well known, luminescent surfaces are coated or impregnated with chemical compositions (i.e. fluorescent or phosphorescent) that collect light, which may be of relatively low luminosity, e.g. ambient light, and respond by emitting light of relatively high luminosity. As is well known, retro-reflective surfaces (i.e. distributions of minute corner reflectors or high refractive index glass beads) return specular light in the direction of its source, e.g. vehicle headlights at night. Regular clothing often is appropriate in service situations. Service clothing often is designed with safety as a special consideration. In any case, it is necessary to minimize the likelihood that a wearer may become a victim when clothing, particularly an accessory vest, is caught accidentally by a vehicle hazard, grasped deliberately during an assault, or contaminated by chemical or biological agents during a rescue effort.

BRIEF DESCRIPTION OF THE INVENTION

The object of the present invention is to provide a protective garment in the form of a light weight, high visibility vest, which is intended to be slipped on and worn over regular or service clothing, but which may removed instantly if required. The garment of the present invention comprises front and back luminescent panels that extend substantially from the shoulders to the waist or hips; mating fastener arrangements or other readily separable fastener arrangements, preferably at the shoulders and the waist or hips, connecting the front and back panels; and retro-reflective bands spanning the front and back panels and bordering regions for the presentation of alphanumeric or other graphic indicia. Preferably, the retro-reflective bands include upper and lower horizontal bands, and retro-reflective bands that extend between the upper horizontal reflective bands and the shoulders, typically in parallel and/or intersecting orientations. Preferably, narrow matching trim bounds free edges of the front and back panels, and opposed edges of the retro-reflective bands. The trim at the free edges is provided by selvedge fabric that overlaps the free edges. The trim at the edges of the bands is provided by backing fabric that extends oppositely beyond the longitudinal edges of the bands. The garment structure is neat and authoritative in appearance, is effectively vivid and informative in operation, and may be easily and instantaneously ripped away from a wearer when required for safety.

BRIEF DESCRIPTION OF THE DRAWINGS

For a fuller understanding of the nature and objects of the present invention, reference is made to the following specification, which is to be taken in connection with the accompanying drawings wherein.

DETAILED DESCRIPTION OF THE PREFERRED EMBODIMENTS

Figure 1:
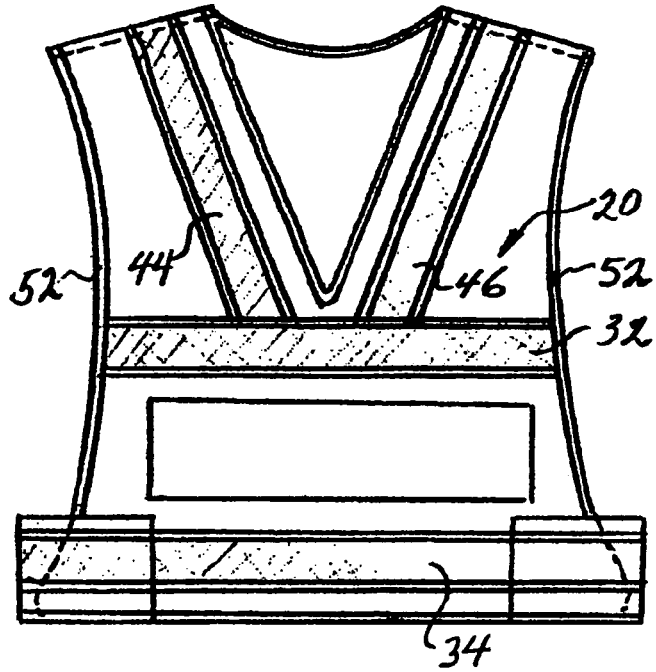
FIG. 1 is a front view of a vest embodying the present invention.
Figure 2:
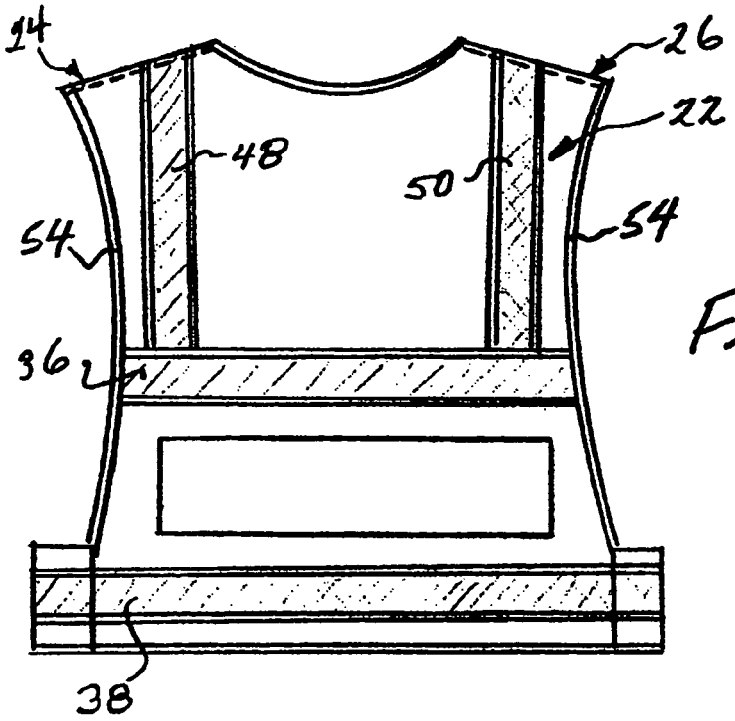
FIG. 2 is a back view of the vest of FIG. 1.
Figure 3:
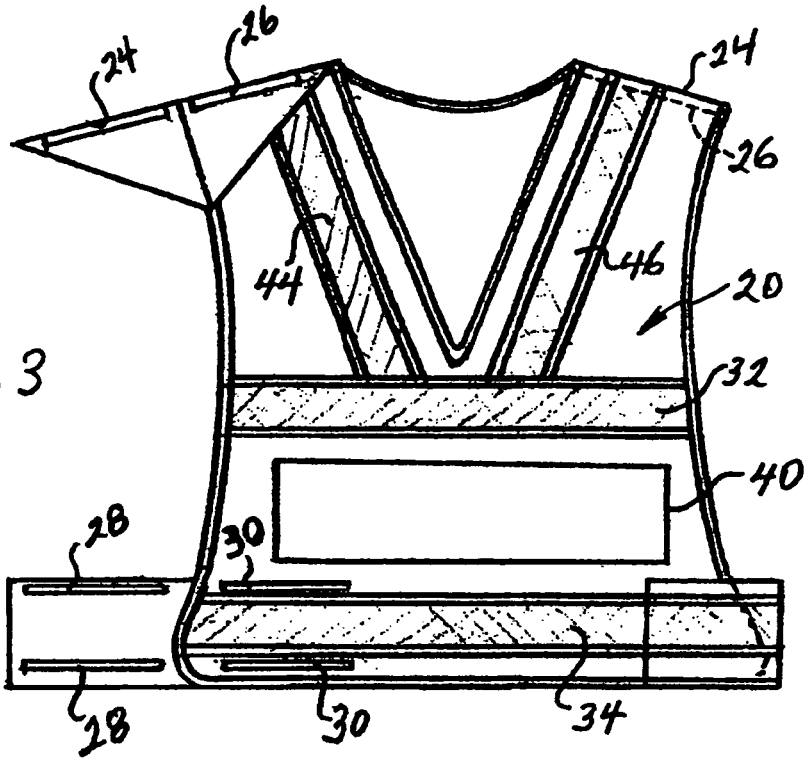
FIG. 3 is a front view of the vest of FIG. 1, partly disassembled to illustrate significant features.
Figure 4:
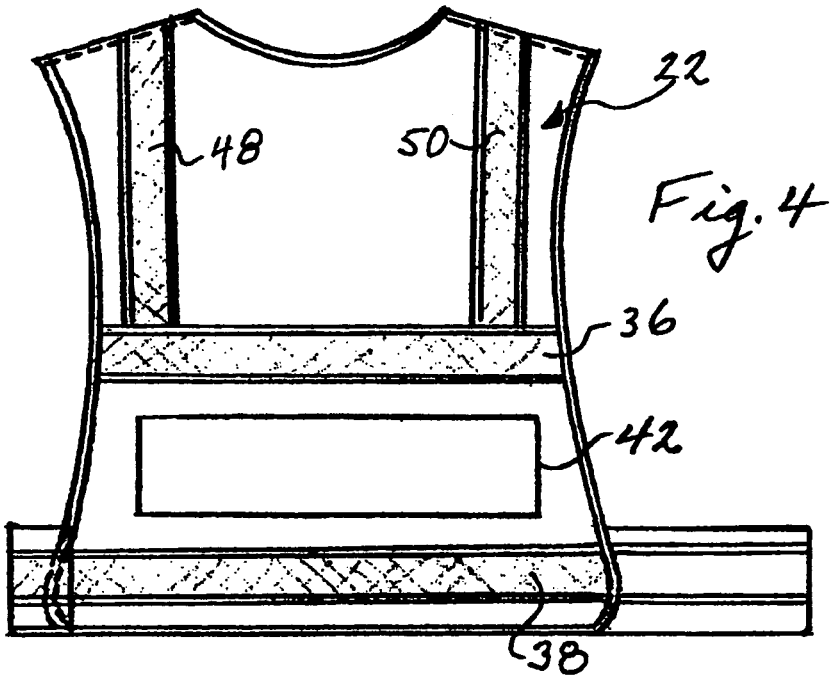
FIG. 4 is a back view of the vest of FIG. 1, partly disassembled to illustrate significant features.

The Vest of FIGS. 1 to 4

The vest illustrated in FIGS. 1 to 4 comprises: front and back luminescent panels 20 and 22 that extend from the shoulders to the waist or hips.

The front and back panels are joined by mating fastener arrangements or other easily separable fastener arrangements 24, 26 at the shoulders, and mating or other easily separable fastener strips 28, 30 at the waist or hips. Upper and lower horizontal retro-reflective bands 32, 34 span the front panel, and upper and lower horizontal retro-reflective bands 36, 38 span the back panel. Bands 32, 34 define a region 40 there between for the presentation of alphanumeric or other graphic indicia. Bands 36, 38 define a region 42 there between for the presentation of alphanumeric or other graphic indicia.

Figure 11:
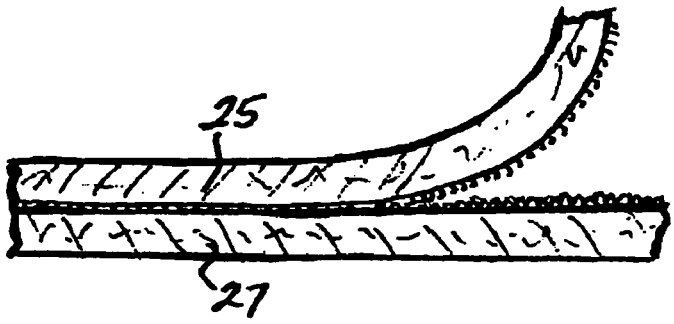
FIG. 11 is an exaggerated, broken-away, cross-section of a micro-meshing hook-and-loop mating fastener strip arrangement of a type used in the vests shown in FIGS. 1–4, 5–6, 7–8, and 9–10.
Figure 12:
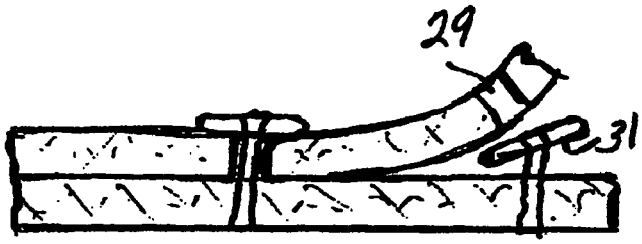
FIG. 12 is an exaggerated, broken-away, cross-section of an alternative mating fastener arrangement, in the form of a series of buttons and button-holes of a type that is alternately used in the vests shown in FIGS. 1–4, 5–6, 7–8, and 9–10.
Figure 13:
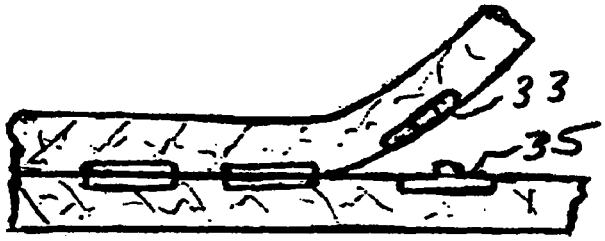
FIG. 13 is an exaggerated, broken-away, cross-section of another alternative mating fastener arrangement, in the form of a series of male and female snaps of a type that is alternately used in the vests shown in FIGS. 1–4, 5–6, 7–8, and 9–10.
Figure 14:
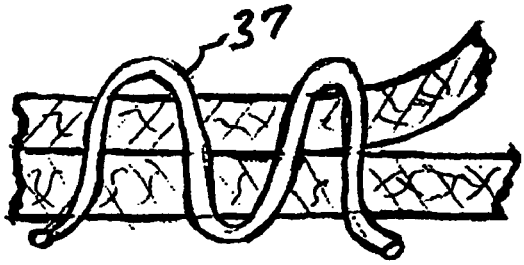
FIG. 14 is an exaggerated, broken-away, cross sectional view of another alternative separable fastener arrangement in the form of a stay stitching assemblage of a type that is alternately used in the vests shown in FIGS. 1–4, 5–6, 7–8, and 9–10.

As shown, retro-reflective bands 44, 46 on the front panel diverge from upper horizontal retro-reflective band 32 to the shoulders. As shown, retro-reflective bands 48, 50 on the back panel extend in parallel between the upper horizontal retro-reflective band and the shoulders. The upper ends of bands 44, 46 and the upper ends of bands 48, 50, respectively, meet to provide an appearance of continuity. In the preferred form shown in FIGS. 1 to 4, fastener arrangements 24, 26 and fastener arrangements 28, 30 are constructed from mating pairs of hook-and-loop micro meshing strips of the type sold by Velcro Industries BV under the trademark VELCRO. The construction of these hook-and-loop micro-meshing strips is suggested at 25, 27 in FIG. 11. It is to be understood that these mating arrangements, in less preferred forms, alternatively may be constructed from: series of button/buttonhole constructions as shown at 29, 31 in FIG. 12; series of male/female snap constructions as shown at 33, 35 in FIG. 13; and temporary stay stitching as shown at 37 in FIG. 14.

Figure 15:
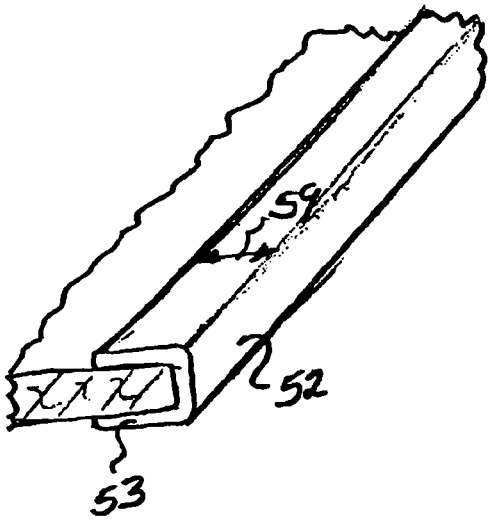
FIG. 15 is an exaggerated, broken-away, cross sectional and orthogonal view of a selvedge of the vests shown in FIGS. 1–4, 5–6, 7–8, and 9–10.
Figure 16:
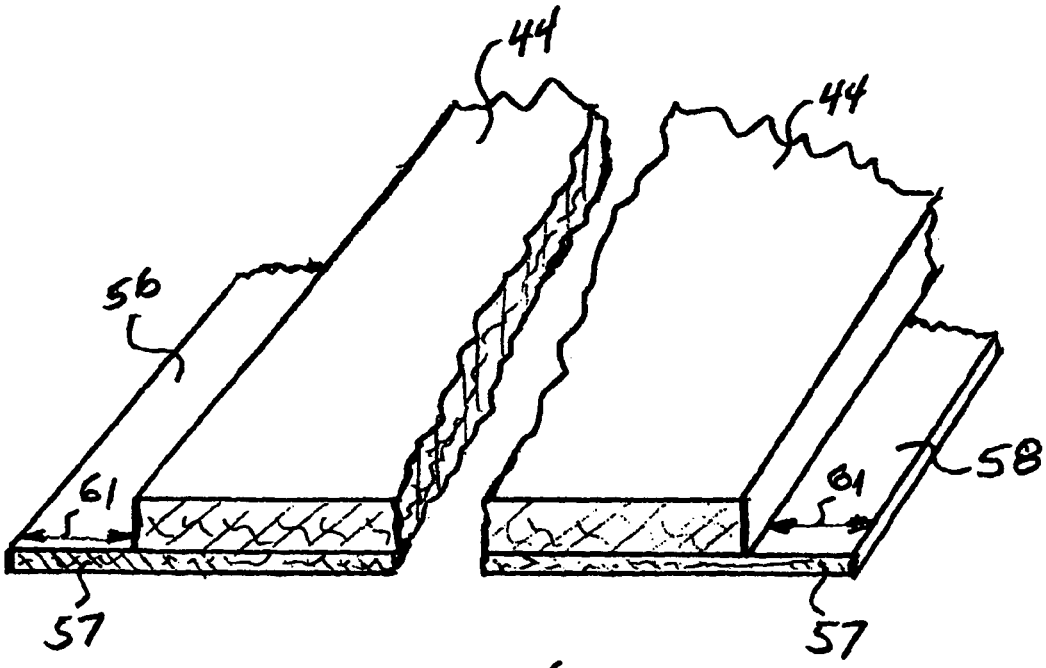
FIG. 16 is an exaggerated, broken-away, cross sectional and orthogonal view of a retro-reflective band construction of a type that is used in the vests shown in FIGS. 1–4, 5–6, 7–8, and 9–10.

Preferably, as shown in FIGS. 1 to 4, aesthetic trim is provided at the free edges 52, 54 of the front and back panels and at the longitudinal edges 56, 58 of the retro reflective bands. The structure of the trim at an edge 52 is shown in FIG. 15 to be an overlapping selvedge 53 that is reversely bent about the edge. The structure of the trim at the edges 56, 58 of a retro-reflective band is shown in FIG. 16 to be provided by an underlying backing 57 that extends oppositely beyond the edges of the band.

The panels, when normally viewed, typically are of highly luminescent color, particularly yellow, green, orange or white. The bands, when normally viewed, generally are dull gray. The trim provides a distinctive and sharp border at the free edges of the front and back panels, and at the edges of the bands. From a visual standpoint, the widths of the trim provided by the selvedges as at 59 and the widths of the trim provided by underlying backing 57 as at 61, are substantially equal for aesthetic harmony.

Preferably, front and back panels 20, 22 are composed of tightly knit or woven strands of polyester or polypropylene, and are characterized by a denier ranging from 30 to 500 and a weight ranging from 2 to 6 ounces per square yard. This polymeric fabric is finished with a high chromaticity fluorescent dye, for example ANSI/ISEA 107-2004. The retro-reflective bands are sold by Minnesota Mining and Manufacturing Corporation under the trade designation, SCOTCHLITE. The composition of the panel fabric is sufficiently light and breathable to enable its being worn, with virtually no ergonomic effect on underlying clothing under varied weather conditions.

Figure 5:
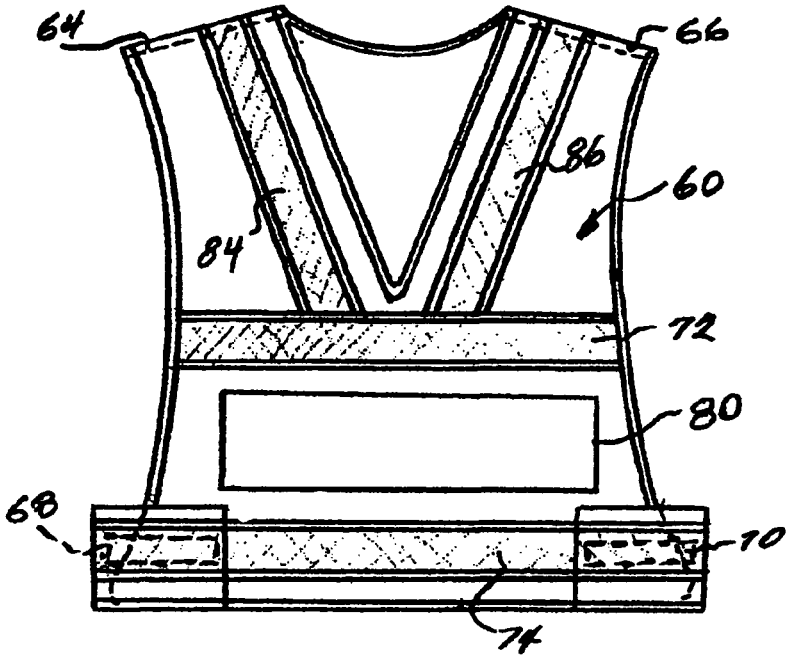
FIG. 5 is a front view of another vest embodying the present invention.
Figure 6:
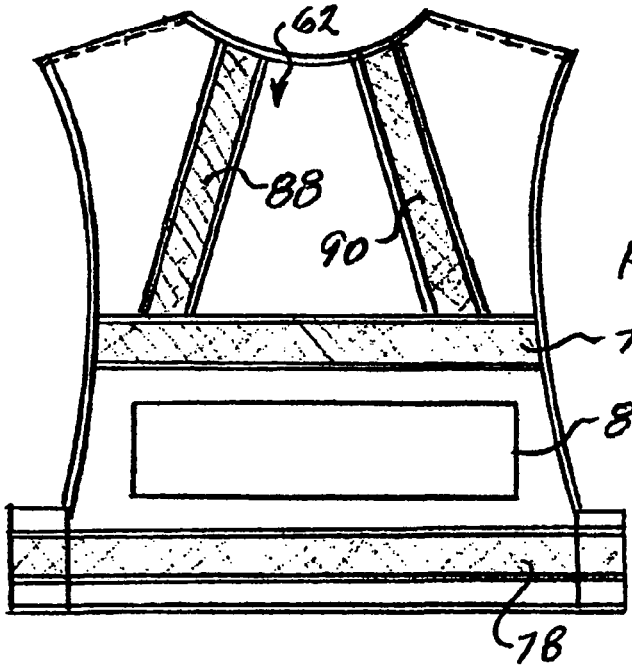
FIG. 6 is a back view of the vest of FIG. 5.

The Vest of FIGS. 5 and 6

The vest illustrated in FIGS. 5 and 6 comprises: front and back luminescent panels 60 and 62 that extend between the shoulders and the waist or hips. The front and back, panels are joined by mating or other easily separable fastener strips 64, 66 at the shoulders, and by mating or other easily separable fastener strips 68, 70 at the waist or hips. Upper and lower horizontal retro-reflective bands 72, 74 span the front panel, and upper and lower horizontal retro-reflective bands 76, 78 span the back panel. Bands 72, 74 define or border a region 80 there between for the presentation of alphanumeric or other graphic indicia. Bands 76, 78 define a region 82 there between for the presentation of alphanumeric or other graphic indicia. As shown, upwardly converging retro-reflective bands 84, 86 on the front panel extend between the upper horizontal retro-reflective band and the shoulders.

As shown, upwardly converging retro-reflective bands 88, 90 on the back panel extend between the upper horizontal retro reflective band and the neck.

Figure 7:
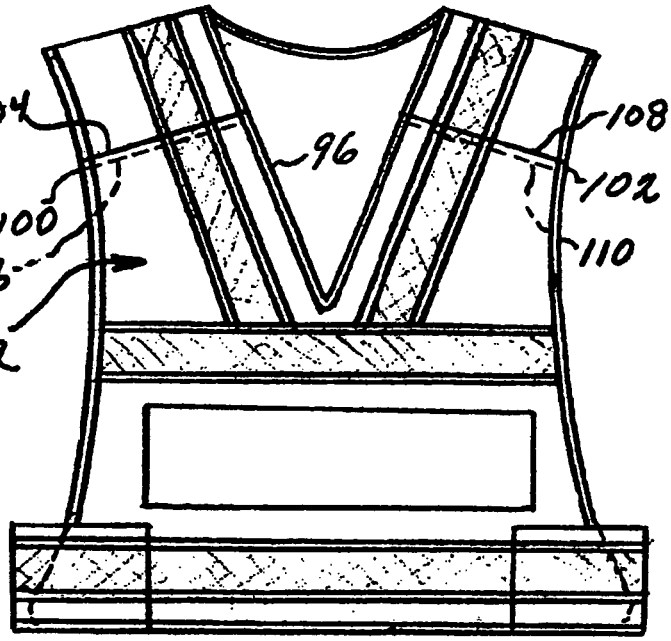
FIG. 7 is a front view of a further vest embodying the present invention.
Figure 8:
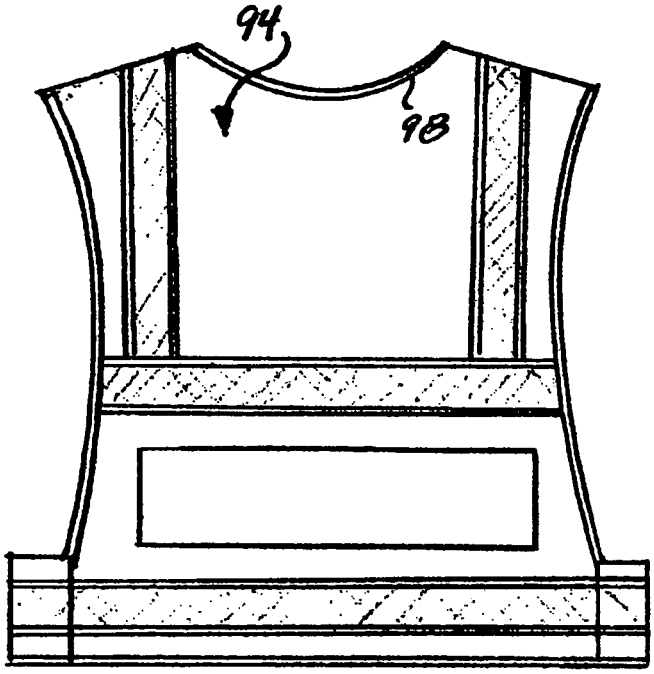
FIG. 8 is a back view of the vest of FIG. 7.

The Vest of FIGS. 7 and 8

The vest illustrated in FIGS. 7 and 8 comprises: front and back luminescent panels 92 and 94 that extend between the shoulders and the waist or hips. Front panel 92 has V-neck opening 96. Back panel 94 has a turtle neck opening 98. Lower and upper sections of the front panel are separated along slits 100, 102, which extend from V-neck opening 96 to the openings at the arms. Joining the upper and lower sections of the front panel are mating or other easily separable fastener ships 104, 106 and 108, 110, which extend across the chest from V-neck opening 96 to the openings at the arms. The remaining elements of the vest of FIGS. 7 and 8 are similar to corresponding elements of the vest of FIGS. 1 to 4, except that the separable fastener strips at the shoulders of the vest of FIGS. 1 to 4 are omitted.

Figure 9:
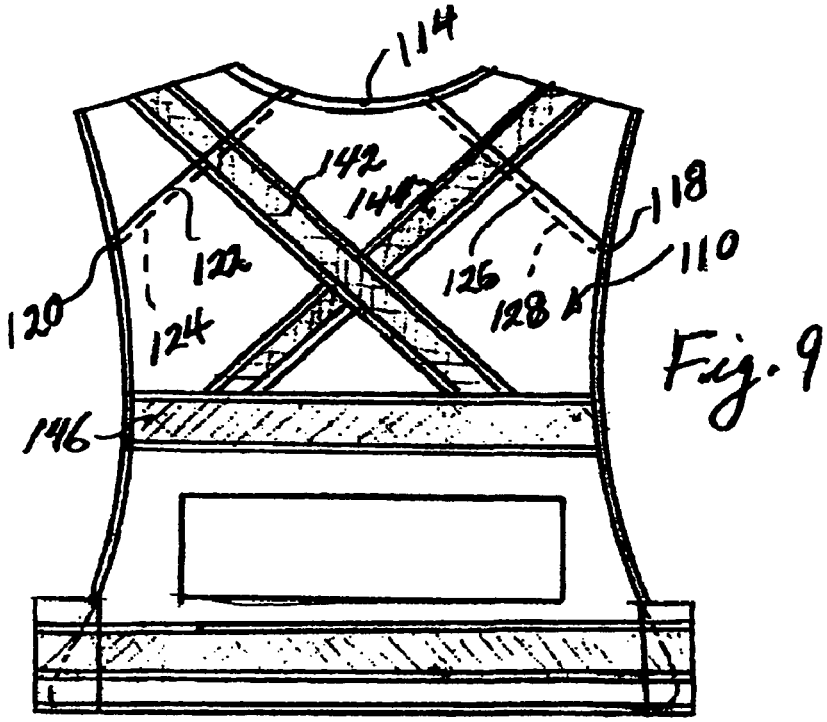
FIG. 9 is a front view of still a further vest of the present invention.
Figure 10:
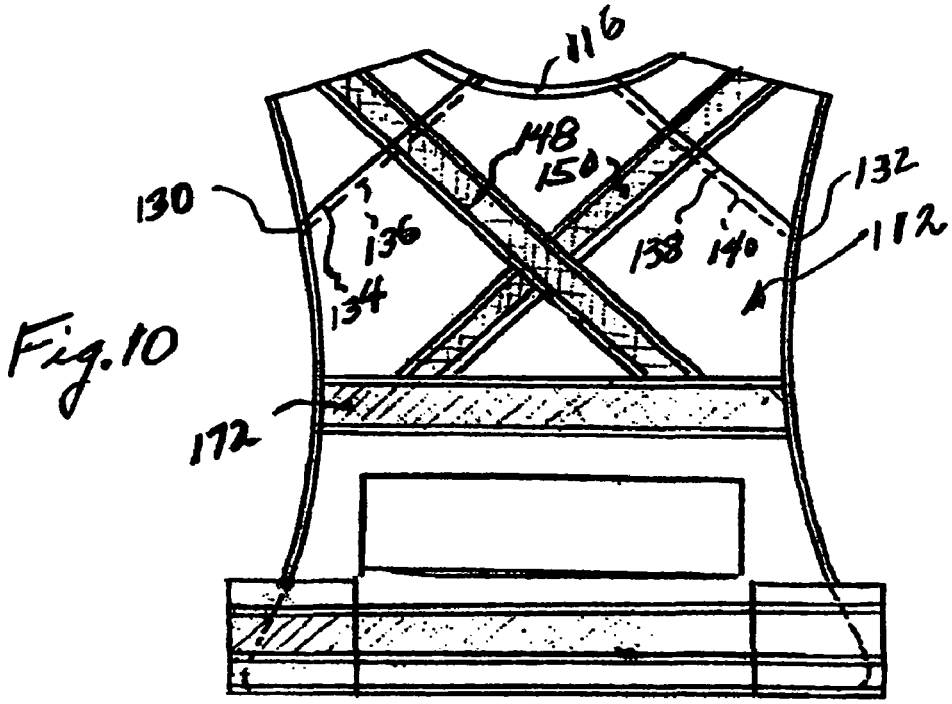
FIG. 10 is a back view of the vest of FIG. 9.

The Vest of FIGS. 9 and 10

The vest illustrated in FIGS. 9 and 10 comprises: front and back luminescent panels 110 and 112 that extend between the shoulders and the waist or hips. Both the front and the back panels have poncho-neck openings, shown at 114 and 116. Lower and upper sections of the front panel are separated along slits 118, 120, which extend from the neck opening to the openings at the arms. Joining the upper and lower sections of the front panel are mating or other easily separable fastener strips 122, 124 and 126, 128, which extend across the chest from the neck opening to the arm openings. Lower and upper sections of the back panel are separated along slits 130, 132, which extend from neck opening 116 to the arm openings. Joining the upper and lower sections of the back panel are easily mating or other easily separable fastener strips 134, 136 and 138, 140, which extend across the chest from neck opening 116 to the arm openings.

Across the front panel are intersecting retroreflective bands 162, 164, which extend from the shoulders to a medial horizontal retroreflective band 146. Across the back panel are intersecting retroreflective bands 148, 150, which extend from the shoulders to a medial horizontal retroreflective 172.

The remaining elements of the vest of FIGS. 9 and 10 are similar to corresponding elements of its counterpart in FIGS. 1 to 4, except that the slits at the shoulders and the associated fastener strips of FIGS. 1 to 4 are omitted.

The duplicate slits 118, 120 and 130, 132 and their associated fastening means on the front and back panels, in the structure of FIGS. 9 and 10, are intended to ensure emergency separation of the front and back panels, particularly where the fastening means are stay stitching.

OPERATION

A light weight, high visibility vest, is worn loosely over regular or service clothing. The vest comprises: front and back luminescent panels that extend from the shoulders to the hips; easily separable fastener means, particularly mating fastener means, at the shoulders and hips connecting the front and back panels; and upper and lower horizontal retro-reflective bands spanning the front and back panels and defining regions there between for the presentation of alphanumeric or other graphic indicia.

Visually sharp trim separates the bands and the panels. Preferably, the distance between the upper and lower bands ranges between 5 and 9 inches in order to provide adequate space for an alphanumeric graphic there between. The vest structure is neat and authoritative in appearance, is effectively vivid and informative in operation, and may be easily and instantaneously ripped away from a wearer when required for safety.

What is claimed is:

1. A high visibility garment comprising:

(a) front and back luminescent panels that extend from the shoulders to the waist and hip region;

(b) detachable fastener means in the vicinity of said shoulders and in the vicinity of said hips connecting said front and back luminescent panels; and (c) retro-reflective bands spanning said front luminescent panel and said back luminescent panel;

(d) whereby said front luminescent panel and said back luminescent panel are separable when one and/or the other is grasped and pulled.

2. The garment of claim 1 wherein said retroreflective bands define regions for the reception of graphic visual matter.

3. The garment of claim 1 wherein lengths of trim visually bound said bands, and visually bound free edges of said panels.

4. The garment of claim 1 wherein lengths of trim visually bound said bands and visually bound said panels, said lengths of trim being substantially equal in transverse width throughout.

5. The garment of claim 1 wherein said fastener means include micro hook-and loop strips.

6. The garment of claim 1 wherein said fastener means include mating series of male and female snaps.

7. The garment of claim 1 wherein said fastener means include mating series of buttons and buttonholes.

8. The garment of claim 1 wherein said fastener means include stay stitching.

9. The garment of claim 1 wherein said panels are fabricated from fibers composed of a polymer selected from the class consisting of polyester and polypropylene.

10. The garment of claim 1 wherein said panels are fabricated substantially from a fabric composed of polymeric fibers selected from the class consisting of polyesters and polypropylenes, said fabric having a denier ranging from 70 to 500 and a weight ranging from 2 to 6 ounces per square yard.

11. A high visibility garment comprising:

(a) front and back luminescent panels;

(b) detachable fastener means at the shoulders and the waist and hip region connecting said front and back panels;

(c) upper and lower retro-reflective bands spanning said front panel;

(d) upper and lower retro-reflective bands spanning said back panel;

(e) said upper and lower retro-reflective bands defining regions that include graphic visual matter;

(f) retro-reflective bands extending from said upper retro-reflective band on said front panel to said shoulders on said front panel;

(g) retro-reflective bands extending from said upper retro-reflective band on said back panel to said shoulders on said back panel; and (g) lengths of trim distinctively bounding said bands, and distinctively bounding free edges of said panels.

12. The garment of claim 11 wherein said fastener means include mating micro hook-and-loop strips.

13. The garment of claim 11 wherein said fastener means include mating series of male and female snaps.

14. The garment of claim 11 wherein said fastener means include mating series of buttons and buttonholes.

15. The garment of claim 11 wherein said fastener means include stay stitching.

16. The garment of claim 11 wherein said panels are fabricated from woven or knit fibers composed of a polymer selected from the class consisting of polyester and polypropylene.

17. The garment of claim 11 wherein said panels are fabricated from woven or knit polymeric fabric with fibers composed of a polymer selected from the class consisting of polyesters and polypropylenes, said fabric having a denier ranging from 70 to 500 and a weight ranging from 2 to 6 ounces per square yard.

18. A high visibility garment which is to be worn over regular or service clothing, said vest comprising:

(a) a front panel and back panel that extend about the body;

(b) hook-and-loop micro-meshing strips at the upper body and the lower body detachably connecting said front panel and said back panel;

(c) a front lower retro-reflective band and a front upper retro-reflective band horizontally spanning body locations in substantial parallel;

(d) a back lower retro-reflective band and a back upper retro-reflective band horizontally spanning body locations in substantial parallel;

(e) retro-reflective bands on said front panel extending between said front upper horizontal band and strategic locations at said shoulders;

(f) retro-reflective bands on said back panel extending between said back upper horizontal band and strategic locations at said shoulders;

(g) said micro-meshing strips at each of said shoulders including a first mating strip that is sewn to an upper edge of said front panel, and a second mating strip that is sewn to an upper edge of said back panel;

(h) said lower back retro-reflective band being provided with opposed extensions that loop forwardly about said body and are fastened by said lower micro-meshing strips to the outer ends of the front retro-reflective band at said lower body;

(i) said opposed extensions having retro-reflective bands that visually are continuations of said lower back retro-reflective band and said lower front retro reflective band;

(j) matching trim being provided at free edges of said front panel and said back panel by thin selvedges, said matching trim being reversely bent about said free edges; and (k) matching trim being provided at opposed longitudinal edges of said retro-reflective bands by underlying backing that extends oppositely beyond said opposed longitudinal edges of said bands;

(l) said front panel and said back panel being composed of a fabric composed of knit or woven strands of polyester or polypropylene, and are characterized by a denier ranging from 70 to 500 and a weight ranging from 2 to 6 ounces per square yard;

(m) said fabric being treated with a high chromaticity, high luminosity fluorescent dye;

(n) said vest being effectively vivid in operation, and said mating fastener strips being easily separated as a safety measure when needed;

(o) longitudinal edges of certain of said retro-reflective bands being stitched to said front panel;

(p) longitudinal edges of certain of said retro-reflective bands being stitched to said back panel;

(q) longitudinal edges of said retro-reflective bands being stitched to said underlying backing and said retro reflective bands.

19. The garment of claim 18 wherein said upwardly extending retro reflective bands on said front panel are crossed.

20. A high visibility garment, said garment comprising:

(a) a front panel and a back panel that extend substantially from the shoulders substantially to the waist and hip region;

(b) hook-and-loop micro-meshing strips at said shoulders and said hips detachably connecting said front panel and said back panel;

(c) front retro-reflective bands spanning the chest;

(d) back retro-reflective bands spanning the back;

(e) said micro-meshing strips at each of said shoulders including a first mating strip that is sewn to a an upper edge of one of said panels, and a second mating strip that is sewn to an upper edge of the other of said panels;

(f) matching trim at free edges of said front panel and said back panel being presented by trim fabric that is reversely bent about said free edges; and (g) matching trim at opposed longitudinal edges of said retro-reflective bands being presented by backing fabric that extends oppositely beyond said opposed longitudinal edges of said retro-reflective bands;

(h) said front panel and said back panel being fabricated from strands of polyester or polypropylene, and being characterized by a denier ranging from 70 to 500 and a weight ranging from 2 to 6 ounces per square yard;

(i) said fabric of said front panel and of said back panel being treated with a high chromaticity, high luminosity fluorescent dye;

(j) said vest being effectively vivid in operation, and being easily ripped from a wearer for safety when needed.

21. A garment comprising:

(a) a front section and a back section; said front section having free edges;

(b) at least one retro-reflective band on at least one of said sections;

(c) trim at certain of said free edges and at certain of said bands;

(d) said trim at said certain of said free edges being provided by an overlapping selvedge that is reversely about said certain of said free edges;

(e) said trim at said certain of said bands being provided by an underlying backing that extends oppositely beyond the edges of the band;

(f) the widths of said trim at said free edges and of said trim at said edges of said band being substantially equal for aesthetic harmony.

22. An elongated visual band for affixation to clothing, said band comprising:

(a) a discrete elongated front stratum and a discrete elongated back stratum;

(b) said front stratum being retro-reflective;

(c) said back stratum being diffusely reflective;

(d) said back stratum extending transversely beyond the longitudinal edges of said front stratum to provide visual trim.

23. A high visibility garment, said garment comprising:

(a) a front panel and a back panel that extend substantially from the shoulders substantially to the waist and hip region;

(b) front retro-reflective bands on said front panel;

(c) back retro-reflective bands on said back panel;

(d) first trim at free edges of said front panel and said back panel being presented by trim fabric that is reversely bent about said free edges; and (e) second trim at opposed longitudinal edges of said retro-reflective bands being presented by backing fabric that extends oppositely beyond said opposed longitudinal edges of said retro-reflective bands;

(f) said first trim and said second trim being of substantially the same color;

(g) said fabric of said front panel and of said back panel being highly luminous.

24. A high visibility garment, said garment comprising:

(a) a front panel and a back panel that extend substantially from the shoulders substantially to the waist and hip region;

(b) front retro-reflective bands spanning the chest;

(c) back retro-reflective bands spanning the back;

(d) first trim at free edges of said front panel and said back panel being presented by trim fabric that is reversely bent about said free edges; and (e) second trim at opposed longitudinal edges of said retro-reflective bands being presented by backing fabric that extends oppositely beyond said opposed longitudinal edges of said retro-reflective bands;

(f) said first trim and said second trim being of substantially the same color;

(g) said fabric of said front panel and of said back panel being highly luminous.

25. A high visibility garment, said garment comprising:

(a) a front panel and a back panel that extend substantially from the shoulders substantially to the waist and hip region;

(b) front retro-reflective bands bounding an alphanumeric presentation at the chest;

(c) back retro-reflective bands bounding an alphanumeric presentation at the back;

(d) first trim at free edges of said front panel and said back panel: and (e) second trim at opposed longitudinal edges of said retro-reflective bands;

(f) said first trim and said second trim being of substantially the same color;

(g) said fabric of said front panel and of said back panel being treated with a high luminosity fluorescent dye.

* * * * *